US008164032B2

(12) United States Patent
Schaffer et al.

(10) Patent No.: US 8,164,032 B2
(45) Date of Patent: Apr. 24, 2012

(54) COOKTOP CONTROL AND METHOD FOR MANUALLY ADJUSTING THE SETTING ON AN OPERATING LINE

(75) Inventors: Frank Schaffer, Pottenstein (DE); Thomas Kraus, Koenigstein (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 1189 days.

(21) Appl. No.: 11/975,116

(22) Filed: Oct. 17, 2007

(65) Prior Publication Data

US 2008/0221735 A1 Sep. 11, 2008

(30) Foreign Application Priority Data

Nov. 9, 2006 (DE) ..... 10 2006 052 875

(51) Int. Cl.
*H05B 3/68* (2006.01)
*H01J 5/16* (2006.01)

(52) U.S. Cl. ..... 219/497; 250/216

(58) Field of Classification Search ..... 219/497, 219/502, 506, 518, 445.1, 446.1, 447.1, 448.11, 219/448.12; 250/216, 227.11, 227.14, 221; 345/173–175

See application file for complete search history.

(56) References Cited

U.S. PATENT DOCUMENTS 3,621,268 A * 11/1971 Friedrich et al. ..... 250/214.1
4,701,747 A * 10/1987 Isherwood et al. ..... 341/24

FOREIGN PATENT DOCUMENTS

| | | |
|---|---|---|
| DE | 10337743 | 3/2005 |
| DE | 10359561 | 8/2005 |
| DE | 102004024835 | 10/2005 |
| DE | 102004054322 | 6/2006 |

* cited by examiner

*Primary Examiner* — Sang Paik
(74) *Attorney, Agent, or Firm* — Jordan and Hamburg LLP

(57) ABSTRACT

A cooktop has a plurality of reflection-sensitive infrared sensors. A plurality of IR receiving elements is arranged along an operating line having a density such that an operator's finger placed on the operating line necessarily covers at least one of the IR receiving elements. A smaller number of IR transmitter diodes is arranged in correspondingly lower density next to the operating line. In the setting process, two effects are used on the operating line, specifically both the radiation of the optical transmitter reflected by the finger and also the radiation of the ambient light that is thrown into shadow by the finger. The resultant signal distribution on the optical receivers can be used for reliable evaluation of the finger's position in nearly all environmental conditions.

18 Claims, 11 Drawing Sheets

Fig. 1
(Prior Art)
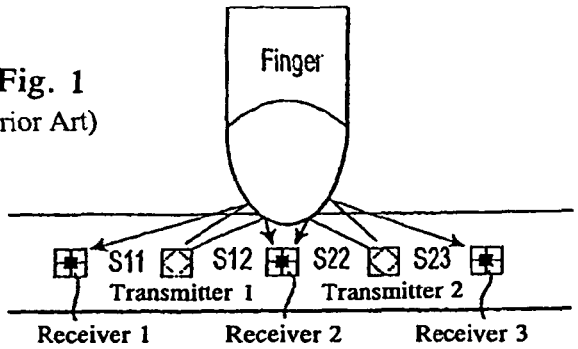
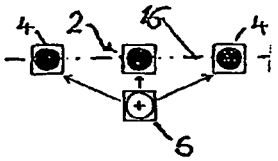
Fig. 2 (Prior Art)
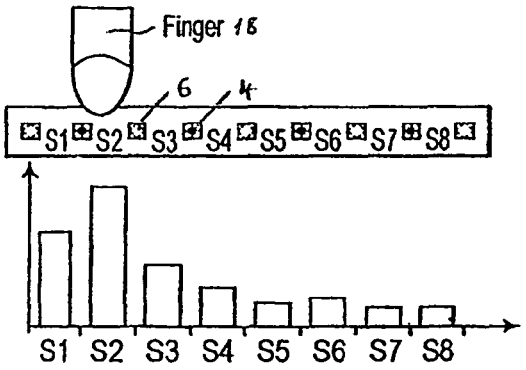
Fig. 3 (Prior Art)
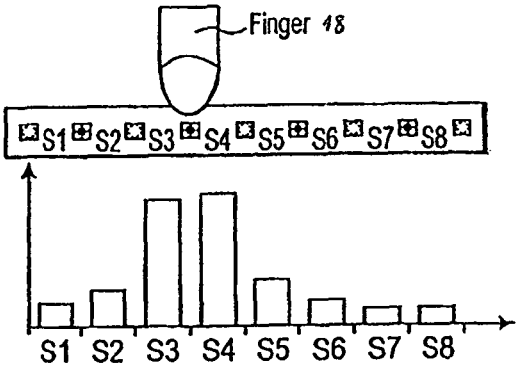
Fig. 4
$$X = \frac{\sum_{i=1}^{N} S(i) * i}{\sum_{i=1}^{N} S(i)}$$

Fig. 2a (Old arrangement, high environmental brightness, transistor in saturation)
(Prior Art)
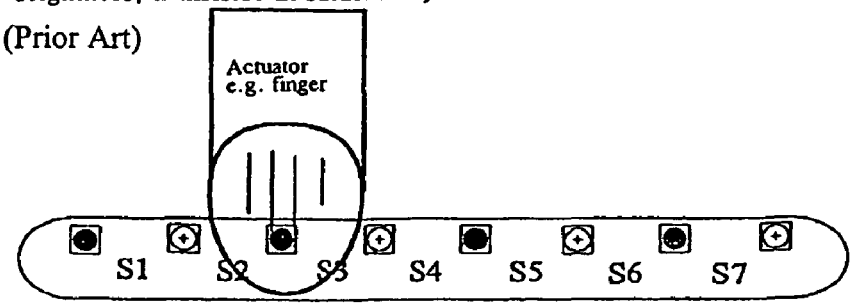
Sensor: S1 to S7
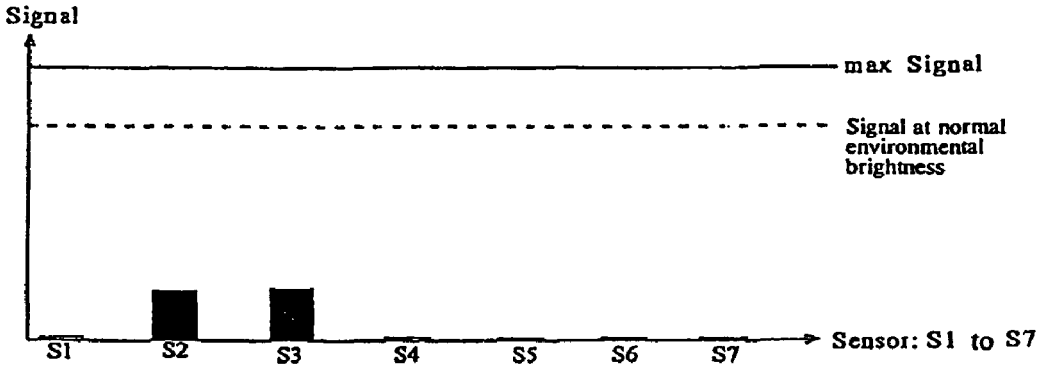
Fig. 3a (Old arrangement, high environmental brightness, transistor in saturation)
(Prior Art)
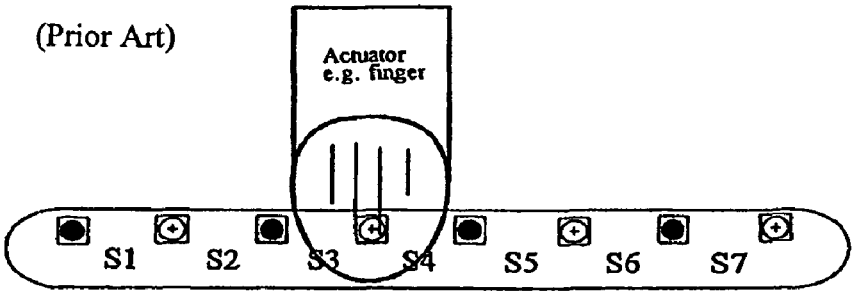
Sensor: S1 to S7
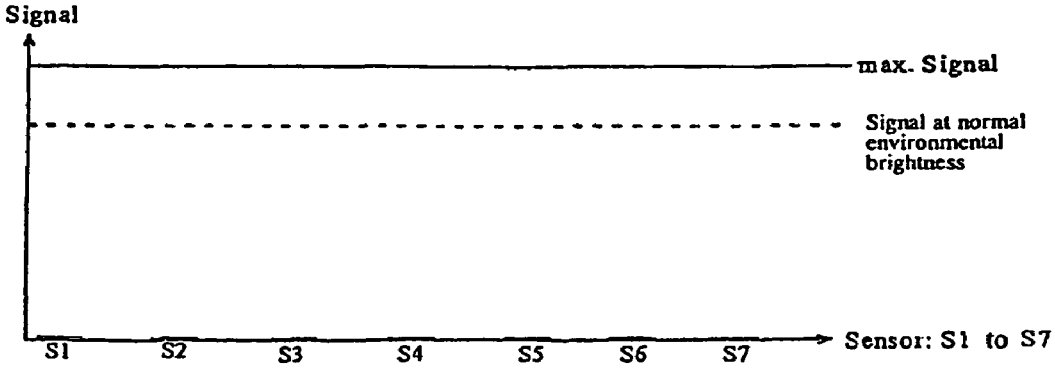

Fig. 2b (normal environmental brightness)
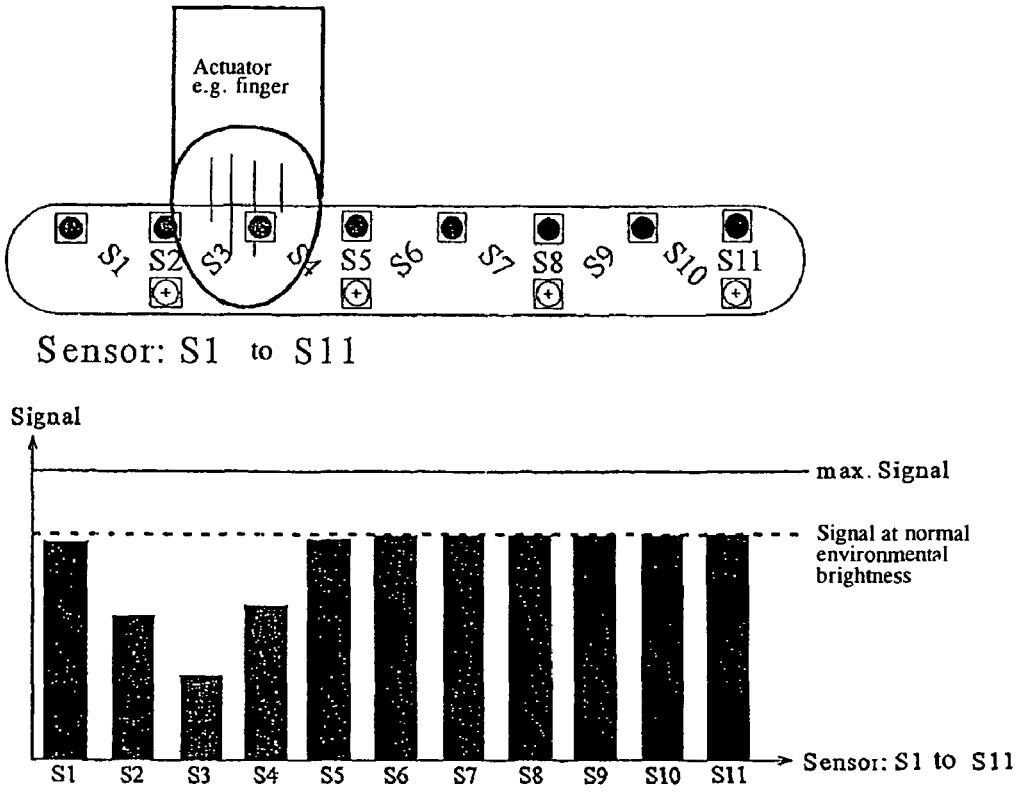
Fig. 3b (normal environmental brightness)
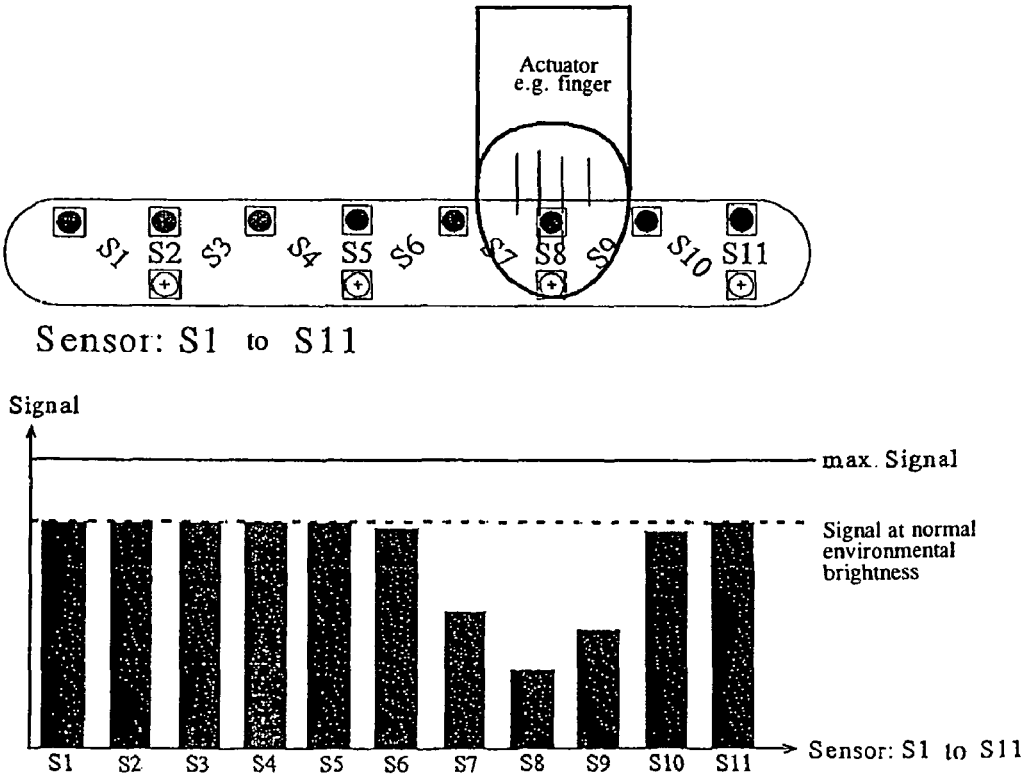

Fig. 2c (High environmental brightness, transistor in saturation)
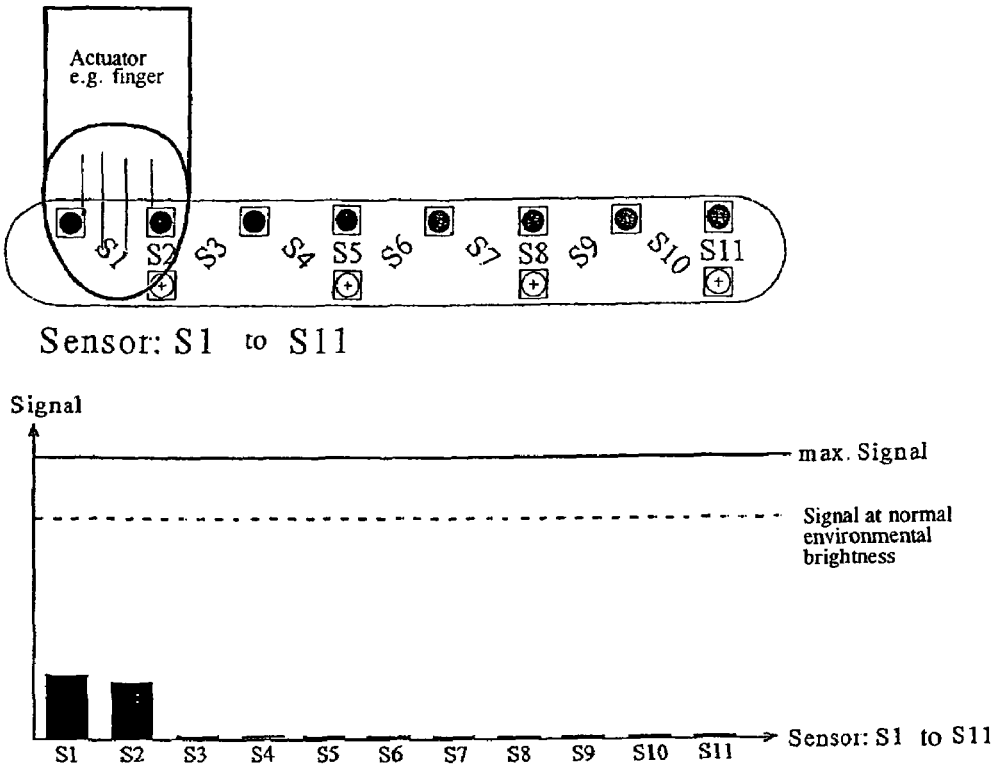
Fig. 3c (High environmental brightness, transistor in saturation)
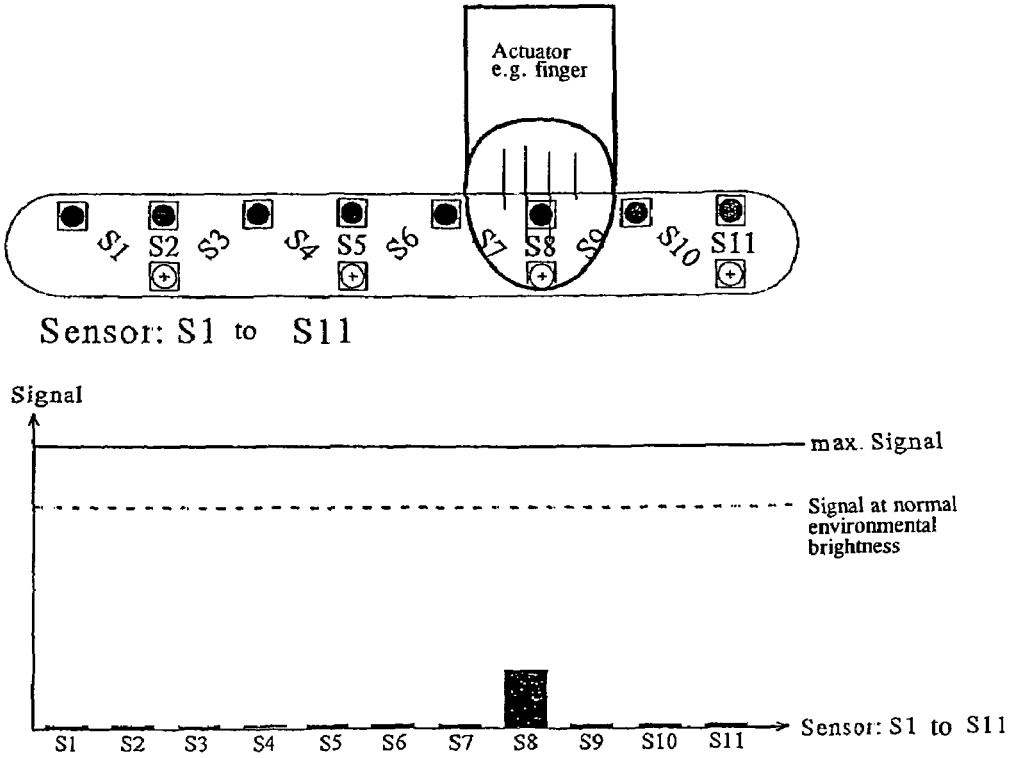

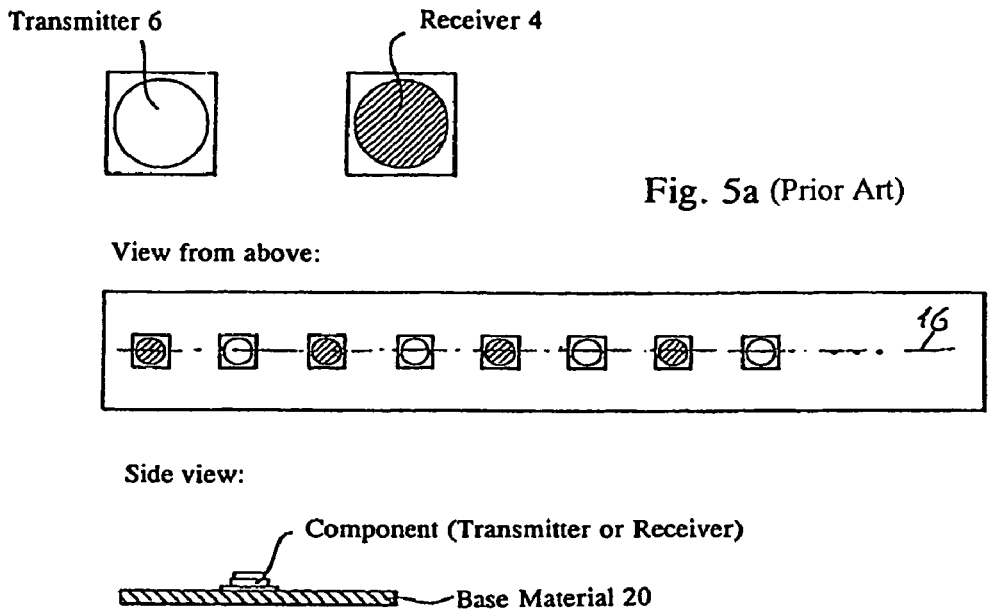
Fig. 5a (Prior Art)
Fig. 6
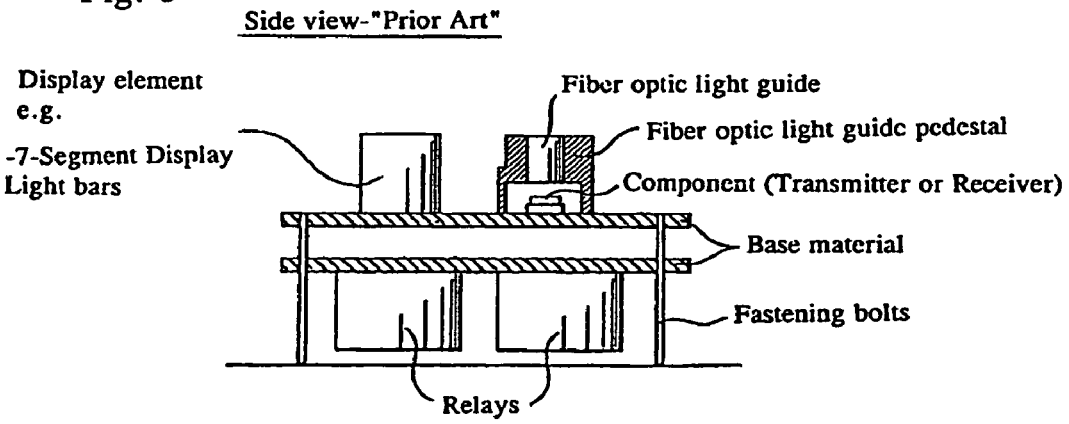
Fig. 7
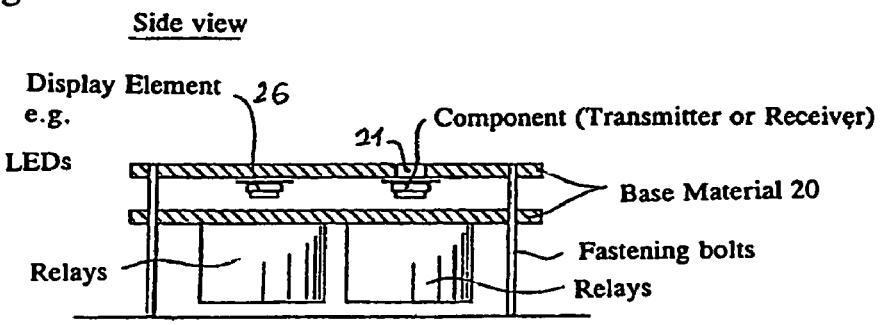

Fig. 5b
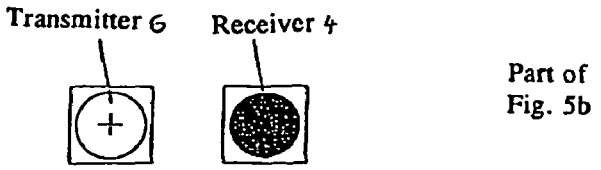
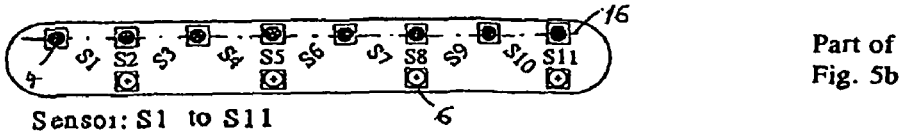
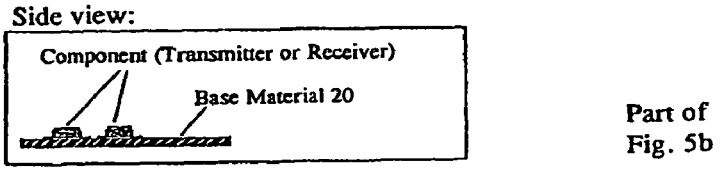
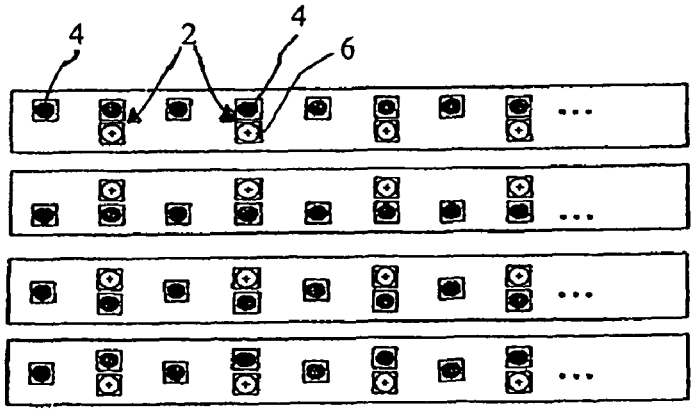
Fig. 14
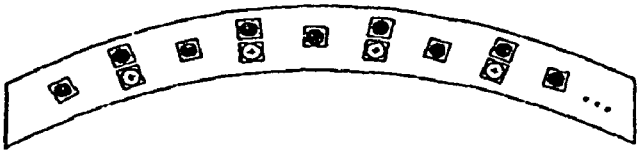
Fig. 15

View from above:

IR Sensor exchanged for sensors having wavelengths in the visible range

View from above:

View from above:

1. LED is not visible

2. LED is visible

COOKTOP CONTROL AND METHOD FOR MANUALLY ADJUSTING THE SETTING ON AN OPERATING LINE

BACKGROUND OF THE INVENTION

The invention relates to a control for a household appliance, in particular a cooktop control having a plurality of reflection-sensitive infrared sensors and furthermore relates to a method for manually adjusting the setting on an operating line.

Known from patent DE 10 2004 024 835 B3 is a cooktop control having a plurality of IR sensors arranged along an operating line. While the phototransistors belonging to the IR sensors form the operating line, a plurality of IR transmitter diodes, which does not necessarily have to match the plurality of IR phototransistors, is arranged in its vicinity.

Known from patent DE 10 2004 054 322 B3 is a method for adjusting the setting on such an operating line in which the position resolution for the reflecting finger tip is enhanced beyond just the distance to the receiver. Proceeding from an alternating arrangement of optical transmitters and receivers along the operating line, scattered light is admitted onto a plurality of receivers and the light distribution on all optical receivers is evaluated.

SUMMARY OF THE INVENTION

The present invention improves upon the geometric sensor arrangements described in DE 10 2004 835 B3 in order to provide a cooktop control optimized for certain operating conditions.

The present invention also improves upon the adjustment method disclosed in DE 10 2004 054 322 B3 thereby to optimize the adjustment process for unfavorable operating conditions.

The basic function of the present arrangement and the present method is to precisely measure the position of an operator's finger on the operating line and for instance to convert it to a corresponding cook level. Tests by Applicant have indicated that this adjustment is in general reliable, and specifically is reliable for as long as the function is controlled largely only by the scatteringly reflected light of the transmitter diodes. In practice, however, the adjustment is also influenced by extraneous light from the environment.

In this context, it is particularly problematic that halogen light has a high proportion of IR radiation, which was discovered during investigations of inventive conditions. Although the IR receiving elements are fitted with daylight filters, above a certain brightness the IR radiation is sufficient for controlling a receiving element to saturation. However, daylight and ambient light also contain a certain portion of IR radiation.

This saturation can lead to it no longer being possible to operate the operating line uniformly at all locations. The tests demonstrated that starting at an environmental brightness of approx. 700 lux, the finger touch functions only in the immediate vicinity or directly above a receiving element. However, if the finger is located between two receiving elements, the control behaves as if there were no finger on the operating line. This problem does not occur for individual IR sensors; it only occurs for operating lines.

The object of the invention is to solve this problem, i.e.

- to arrange the IR receiving elements and the IR transmitter diodes structurally usefully along the operating line, specifically such that

- the position resolution is assured for the reflecting finger tip, even under unfavorable environmental conditions.

The inventive cooktop control is equipped with a plurality of infrared sensors that are reflection-sensitive in the usual manner in order to produce a signal when a finger touches it (touch control). A plurality of IR receiving elements is arranged along an operating line, specifically inventively with a density such that an operator's finger placed on the operating line necessarily covers at least one of the IR receiving elements. Thus the ambient light is thrown into shadow for at least one receiving element and thus uniform signal evaluation is attained along the entire operating line, even under unfavorable circumstances. A receiver interval of about 100 mm is particularly preferred.

However, given the increase in the receiver density, it was also demonstrated that conversely there can be savings in the number of IR transmitter diodes relative to the prior art. It is adequate to arrange a clearly smaller number of IR transmitter diodes in correspondingly lower density next to the operating line. In particular the number of IR transmitter diodes can be half the number of IR receiving elements, each of the IR transmitter diodes then being arranged in the immediate vicinity of every second receiving element next to the operating line at a density of 20 mm per transmitter. As a result, a receiving element always alternates with a pair of sensors along the operating line, so that IR light radiated from a transmitter diode is reflected onto an average of three receiving elements.

The method aspect of the invention is characterized in that both the radiation of the optical transmitter that is reflected by the finger and also the radiation of the ambient light that is thrown into shadow by the finger are used for evaluating the finger position. The combined incident light, for which the IR portion is of particular significance, is detected quantitatively at all optical receivers. Since the working point of the optical receivers (phototransistors) is matched to the operating mode in which the reflected light that is coming from the optical transmitters is measured while the ambient light is shadowed, an evaluatable signal distribution occurs under almost all environmental conditions.

The signal distribution is evaluated in principle as disclosed in DE 10 2004 054 322 B3. The position of the finger can be calculated by finding a mean (median point of light distribution) or using similar evaluation methods as in the DE. The advantage of the novel arrangement is comprised in that at least one receiving element, which is in particular an IR phototransistor, is always darkened. Because of the darkening, the working area for at least this transistor is located in an area provided for signal evaluation by reflection. The signal travel for this receiving element can therefore always be evaluated.

Useful further developments and additional advantageous properties are explained using exemplary embodiments illustrated in the drawings.

BRIEF DESCRIPTION OF THE DRAWINGS

FIG. 1 is a schematic depiction of the incident light by reflection, specifically in the transition from the prior art to the invention;

FIG. 2 depicts signal distribution of the incident light on an operating line according to the prior art for a specific position of the actuator or finger;

FIG. 2*a* depicts signal distribution of the incident light as in FIG. 2, but at high environmental brightness;

FIG. 2*b* depicts signal distribution of the incident light as in FIG. 2, at low (normal) environmental brightness, but for an inventive sensor arrangement with higher receiver density;

FIG. 2*c* depicts signal distribution of incident light as in FIG. 2*b* with inventively higher receiver density, and with higher environmental brightens, comparable to FIG. 2*a;*

FIG. 3 depicts signal distribution as in FIG. 2 according to the prior art, but for the actuator or finger in a different position;

FIG. 3*a* depicts signal distribution of the incident light as in FIG. 3, but with higher environmental brightness;

FIG. 3*b* depicts signal distribution of the incident light as in FIG. 3, with lower (normal) environmental brightness, but in an inventive sensor arrangement having higher receiver density;

FIG. 3*c* depicts signal distribution of the incident light as in FIG. 3*b*, having inventively higher receiver density, but with high environmental brightness comparable to FIG. 3*a;*

FIG. 4 depicts a formula for calculating the current finger position X as the median point of the inventive light signal distributions as they are depicted in FIGS. 2*b*, 2*c*, 3*b*, and 3*c;*

FIG. 5*a* depicts a top view of optical components, transmitters, and receivers, as well as a top view of a base (printed circuit board) and a sectional view of the narrow side of the base, the optical components being arranged alternately along the operating line in accordance with the cited prior art;

FIG. 5*b* depicts top views and a side view as in FIG. 5, but arranged in accordance with an inventive exemplary embodiment;

FIG. 6 depicts a fiber optic light guide pedestal and a display element in accordance with the prior art;

FIG. 7 depicts an embodiment of the invention in which the optical transmitters and receivers (and also the display elements) are arranged on the bottom side of the base;

FIG. 14 depicts four embodiments of straight or zigzag operating lines in accordance with the invention;

FIG. 15 depicts an embodiment of a curved, zigzag operating line in accordance with the invention;

Figure 8:
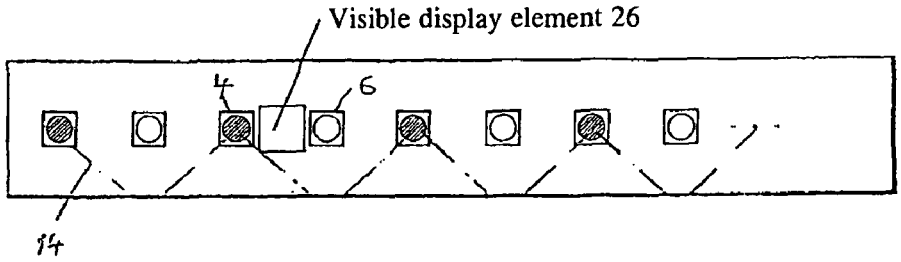
FIG. 8 depicts an embodiment transferred to the inventive cooktop control, in which embodiment the display elements (visible light) are arranged in intermediate positions between the optical components (infrared sensors and infrared receivers)

In accordance with FIG. 1 (left), the cited prior art proceeds from an operating line on which transmitters and receivers are arranged alternately. The incident light therefore leads from a plurality of transmitters 1 . . . N2 via the reflections to a plurality of receivers 1 . . . N1. Each transmitter essentially operates two adjacent receivers, and similarly each receiver obtains light essentially from two adjacent transmitters. In contrast to this, in the invention (to the right in FIG. 1), the receiving elements 4 are denser and the transmitters 6 are less dense. In the preferred exemplary embodiment, one sensor pair 2 (comprising one phototransistor 4 and one transmitter diode 6) is arranged between each two individual receivers (phototransistors 4). Under favorable circumstances, the light of a transmitter 6 can be evaluated at the three adjacent receivers 4 (see FIG. 1); under unfavorable circumstances (with extraneous light) it can still be evaluated at one of the receivers 4, specifically at the receiver 4 that is covered (necessarily and with certainty due to the receiver density) and therefore shadowed against the ambient light. Thus a corresponding sensor value for at least one receiver 4 can be detected at each position of the operating line 16.

FIGS. 2 and 3 depict two typical signal distributions according to the prior art. In this case, the proximity of a transmitter and a receiver to the associated light reflection is called sensor S(i). This signal distribution can be determined with time-sequential activation of the transmitter 6 and detection of the adjacent receiver 4. In FIG. 2, the finger actuates the control further to the left than in FIG. 3. Even a small change in the position of the finger 18 leads to a noticeable change in the signal distribution for the sensors S1 through S8. The present invention also makes use of this effect, as FIGS. 2*b* and 3*b* demonstrate.

However, first FIGS. 2*a* and 3*a* depict how the arrangement in accordance with the prior art reacts to high environmental brightness (Case a). In FIG. 2*a*, the finger 18 is coincidentally located directly above one of the receivers 4. In this Case a, the ambient light is thrown into shadow (i.e. the other receivers are driven into saturation by the ambient light) and the two "neighbor sensors" S2 and S3, in which the shadowed receiving element 4 takes part, receives the reflected IR light in the normal working range. In FIG. 3*a*, however, the finger 18 coincidentally covers an area between two sensors and no evaluatable signal distribution results due to the continuous saturation.

The invention eliminates this problem. The receivers are now distributed with greater density than in the prior art at a preferred interval of about 10 mm. FIGS. 2*b* and 3*b* illustrate the inventive signal distribution with normal environmental brightness (Case b), FIGS. 2*c* and 3*c* at high environmental brightness (Case c). In Case b, the higher receiver density of the invention provides for a better evaluatable envelope curve with more support points; in Case c, with very high environmental brightness, evaluation is still possible.

FIG. 4 provides a general formula for calculating the median point of the measured light distribution. This median point X reflects the actual position of the finger tip with great accuracy. As a result of the calculation of the median point of the light distribution along the operating line, it is possible to calculate many intermediate positions between the sensors and thereby to attain greater resolution than is provided by the arrangement density of the receivers. The result X yields a value between 1 and N1 (N1 receivers required) and can be transformed by appropriate calibration to a different range of values. The resolution is also a function of the quantization of the sensor signals.

In the earlier normal evaluation, in which the measured values were based on a reflection by means of fiber optic light guide pedestal, only clear signals were evaluated. In order to obtain meaningful results, small signals quantized with 1, 2, and 3 were not taken into consideration. With N sensors, individual actuations were evaluated that were based on the fact that the threshold value was exceeded at only one of the N sensors. In addition, double actuations were still evaluated if the actuation threshold was exceeded at two adjacent sensors. In this evaluation at best the positions 1 and 1.5 and 2 and 2.5 and 3 and 3.5 . . . etc. to N could be differentiated. Thus, with this method from the prior art, (2N−1) positions could be clearly detected with N sensors. The median point calculation in accordance with the formula in FIG. 4, on the other hand, clearly makes it possible to calculate more intermediate positions. For instance, let the number of sensors N=8 and the measured signal distribution S(i)=[0, 0, 2, 5, 6, 1, 0, 0]. According to the earlier usual evaluation, the result was a position value of 4.5. The small signal values 0, 1, and 2 were not used in this evaluation. However, the result for the new evaluation used for this example is X−62/14=4.43 (formula in FIG. 4).

Alternatively to the median point for the signal distribution, an extreme value (maximum or minimum) can also be determined, specifically by interpolation with a parabolic, e.g. quadratic, function. For this, similar to the utility model DE 20 2004 019 489 U1, FIGS. 8 through 10, the maximum value of the parabola is sought that is approximated by the three measured values that fall farthest outside of the frame.

FIG. 5*b* depicts the optimized structure compared to the cited prior art in accordance with FIG. 5*a*. Transmitters and receivers are no longer mounted alternating on the operating line 18 (FIG. 5), but rather the majority N1 of IR receiving elements 4 is arranged along the operating line 16 with a greater density than the number N2 of IR transmitter diodes 6. The IR receiving elements 4 are so dense that a finger 18 placed on the operating line 16 necessarily covers at least one of the IR receiving elements 4. And the number N2 of IR transmitter diodes 6, which is half as large, is arranged in the immediate vicinity of every second IR receiving element 4 next to the operating line 16. If the transmitters 6 are controlled in time sequence, in accordance with FIG. 5*b* eleven signals can be realized by means of the "neighboring sensors" S1 through S11. On the other hand, if all transmitters 6 radiate light at the same time, in accordance with FIG. 1 all light portions overlay the receivers 4 and only N1 signals of the receivers 1 through N1 are available.

The lateral section through the base printed circuit board 20 in accordance with FIG. 5*b* illustrates that the optical components in accordance with one embodiment of the invention can be arranged on the top side of the base material. The structural height is substantially less, compared to the prior art, which is illustrated in FIG. 6, because the fiber optic light guide pedestal used in the past is no longer used.

The further exemplary embodiment of the invention in accordance with FIG. 7 also depicts a very low structural height because the optical components (transmitters 6 and receivers 4) can even be moved to the bottom side of the base printed circuit board 20. In this case the display elements 26 that as a rule are formed by light-emitting diodes or 7-segment displays are arranged on the bottom side of the printed circuit board 20. In this case recesses 22 for the optical reflection path from the transmitter 6 to the receiver 4 are provided in the base material 20.

Figure 10:
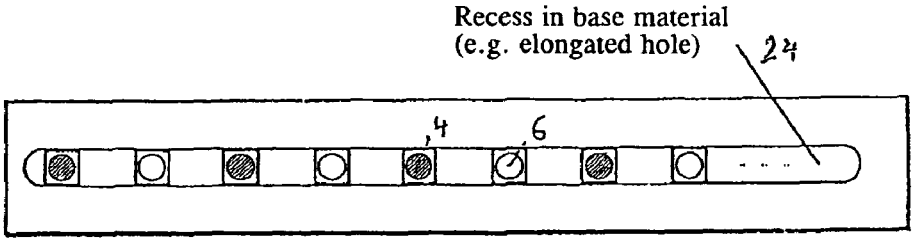
FIG. 10 depicts two top views of a series of components in accordance with FIG. 7 that is located under the base, wherein the recess in the base material can be embodied alternatively as a single large longitudinal hole along the operating line or as a series of smaller openings.
Figure 10:
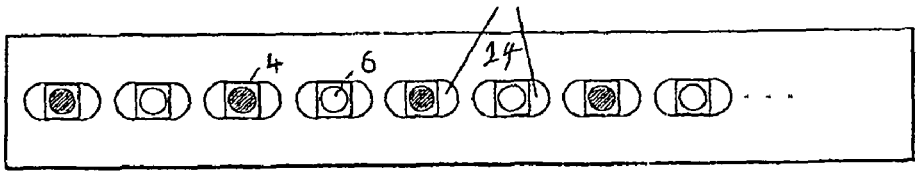

FIG. 10 depicts two possibilities for such recesses 22. In the top view in accordance with FIG. 10, a series of optical components 4, 6 are arranged beneath an elongated hole 24 that extends across the entire operating line 16. Alternatively, in the bottom view in FIG. 10, a shorter elongated hole 24 is provided for each optical component 4, 6. A series of bores 24 can also be sufficient.

Figure 9:
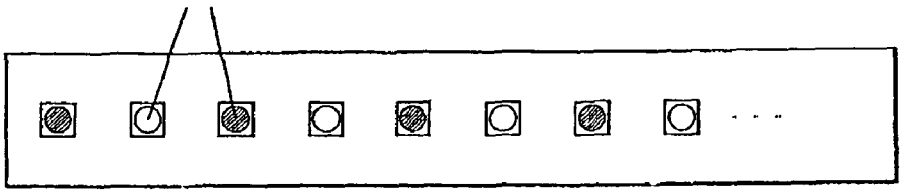
FIG. 9, alternative to the cooktop control in accordance with FIG. 8, depicts an arrangement in which the optical components (transmitters and receivers) work with wavelengths in the visible range and the optical transmitters are used simultaneously as display elements.

FIGS. 8 and 9 depict another alternative that relates to the display elements 26. The display elements 26 visibly display for the operator the parameters set for the cooktop control. In FIGS. 8 and 9, an analog depiction in the form of a "bar graph" has been selected. The depiction in FIGS. 8 and 9 is connected to the embodiment in accordance with FIG. 5*a*, which can be carried over to the inventive embodiment in accordance with FIG. 5*b* with nothing further. The optical components 4, 6 are arranged with a low structural height on the top side of the base material 20. The additional arrangement of the display elements 26 also applies for components 4, 6, 26 located on the bottom in accordance with FIG. 7, however.

In FIG. 8 the operating line in accordance with FIG. 5 and FIG. 5*b* contains an addition in that display elements 26 are arranged at the intermediate positions between every two infrared sensors S1, S2, S3, etc. The display elements do not disturb the sensors 2 due to their shorter wavelength for visible light, while the infrared sensors 2 do not lead to any visible display due to their longer wavelength.

Alternatively, in accordance with FIG. 9, the structure of which corresponds to that in FIG. 5*a* and FIG. 5*b*, sensors for light in the visible range can be used instead of the infrared sensors 2. This can results in savings in terms of components because the optical display element 26 simultaneously functions as the optical transmitter 6. The display 26 is embodied as a "bar graph" and controlled with corresponding impulse packets. When the density of the impulse packet is higher, the light from the light-emitting diode 6 becomes visible, while it remains invisible at a lower impulse packet density (controllable by pulse width modulation PWM). The sensor evaluation is attained using a time multiplex and synchronization with the receivers 4, i.e. the light-emitting diodes 6 are controlled sequentially in the direction of the operating line 16 and the receivers 4 are switched to active in these time windows.

The series of light-emitting diodes 6 as setting indicator or bar graph is overlaid on the time multiplex just explained, i.e. a display-active light-emitting diode 6 is nearly permanently activated. Since the receivers 4 are turned off at this point in time, the control process for operation is not limited.

Figure 11:
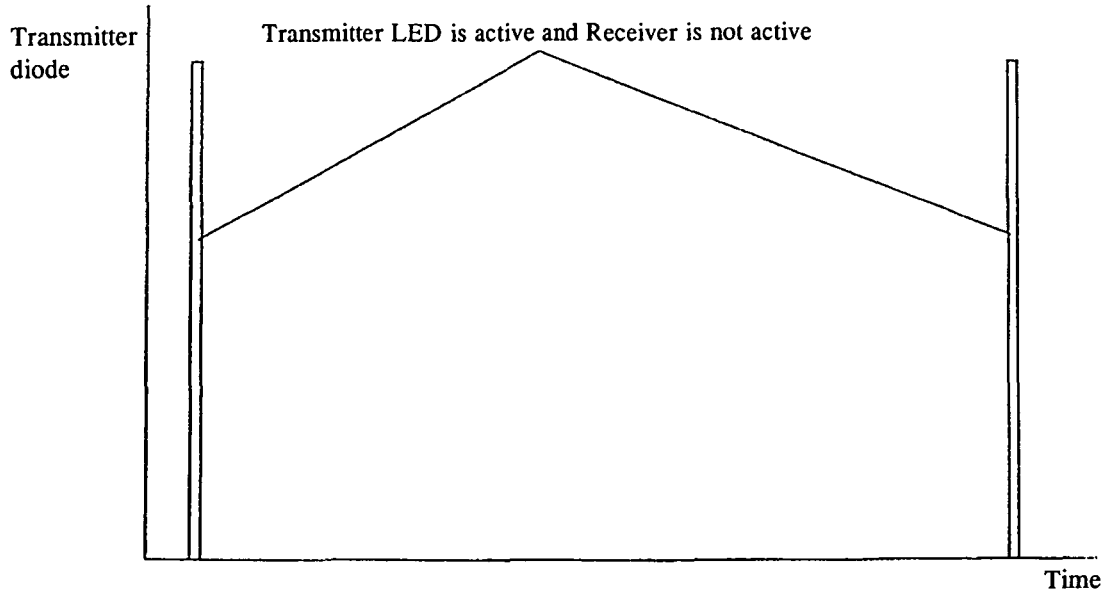
FIG. 11 depicts two time diagrams of transmitted, reflected, and received light impulses, the top diagram depicting a control of a receiver without visible display and the lower diagram depicting a control of a receiver and additional impulses for a visual display.
Figure 11:
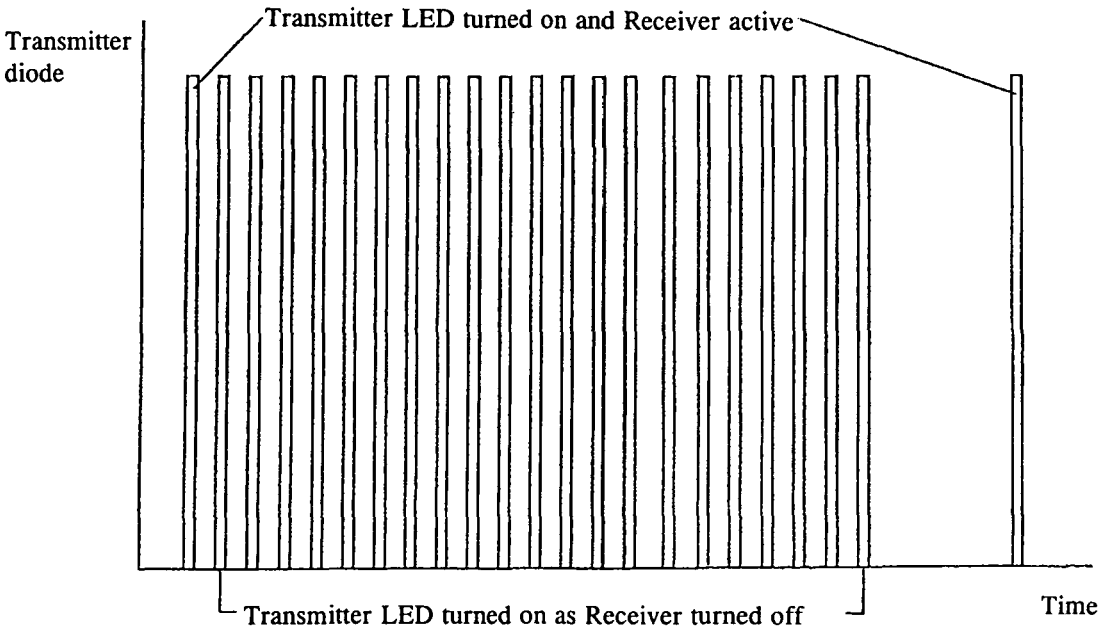

Thus, in this embodiment the light-emitting diodes 6 that radiate visible light are divided into two groups that are a function of the position X of the actuator or finger 18. Only the impulse sequence that is depicted at the top of FIG. 11 is used for the control process. These short light impulses are not visible to the human eye, but allow the receiver 4 to determine the reflected light intensity. The group of light-emitting diodes 6 that is located on the operating line 16 to the right of the finger 18 experiences this activation. The other group of light-emitting diodes 6, which is located on the operating line 16 to the left of the finger tip 18, experiences the activation depicted in FIG. 11. This impulse packet permits the transmitter to become visible to the human eye and indicates the associated heat output as a bar graph.

The alternatives depicted using the different exemplary embodiments can be combined with one another structurally and functionally.

Figure 12A:
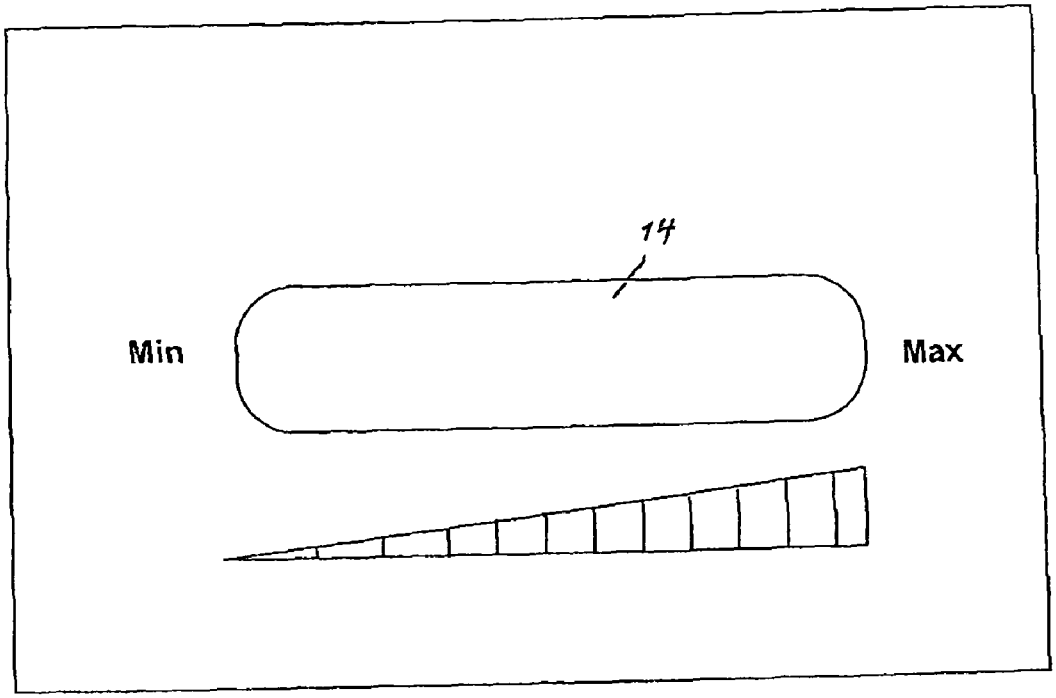
FIG. 12*a* depicts a straight, horizontal actuating surface for an inventive cooktop control, beneath which the operating line is arranged functionally.
Figure 12B:
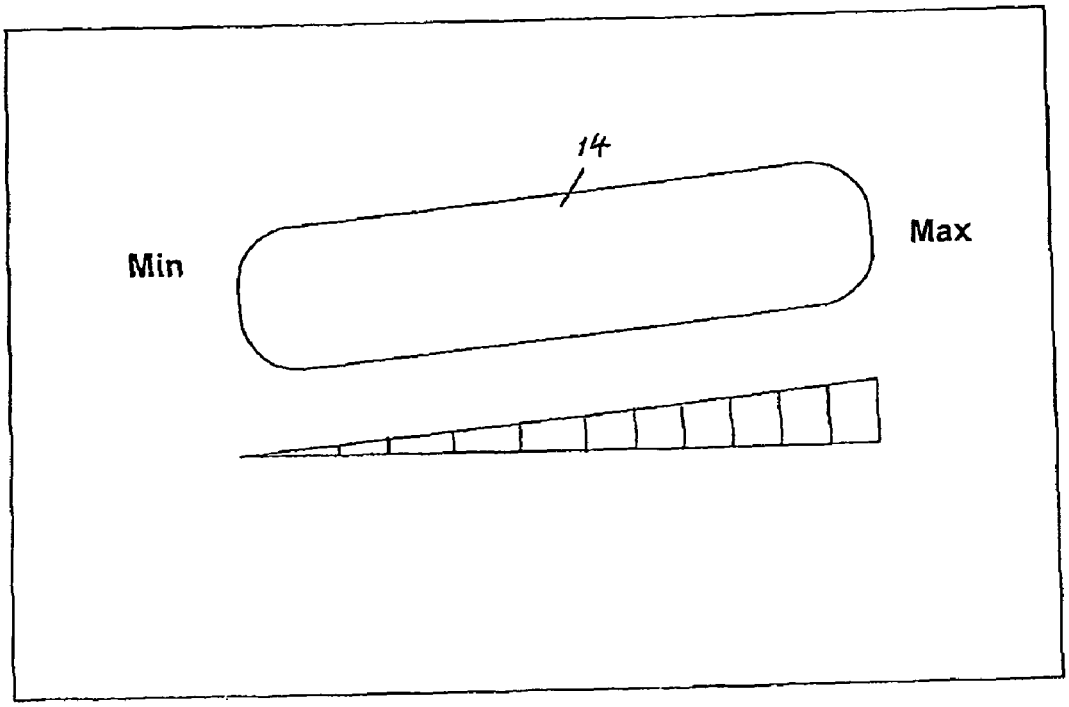
FIG. 12*b* depicts a straight, slanted actuating surface for an inventive cooktop control.

FIG. 12*a* and FIG. 12*b* depict two examples of an actuating surface 14 that is displayed graphically on the cooktop and below which is the operating line 16. In these cases the operating surface 14 is a straight, i.e. a finger 18 can touch or pass over in a straight line the actuating surface 14 between the values MIN and MAX. The cook level set can be displayed like a slide regulator on a graphic signal (wedge symbol) associated with the actuating surface 14. However, the display elements can also be arranged below the actuating surface 14.

In FIG. 12*a*, the actuating surface 14 located along the actuating line 16 is horizontal, in FIG. 12*b* it is slanted. The operating line 16 can also be curved or oscillating in other embodiments.

Figure 13A:
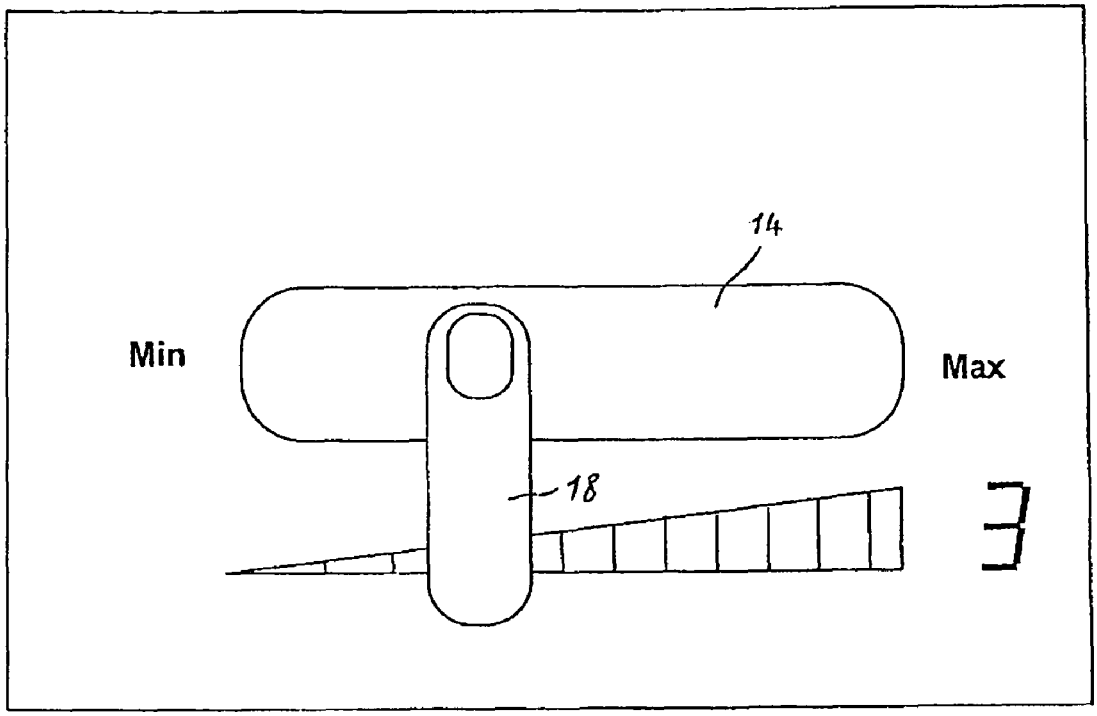
FIG. 13*a* depicts direct selection of a cook level.

The inventive cooktop control is operated as follows. By touching a certain position on the actuating surface 14, it is possible to directly select a cook level that is associated with this position. For instance, if the maximum cook level that can be set is "9" and the actuating surface 14 is touched in the first third, cook level "3" is set. FIG. 13*a* depicts this process of directly selecting cook level "3", cook level 3 in this case being displayed as a digital numeral.

Figure 13B:
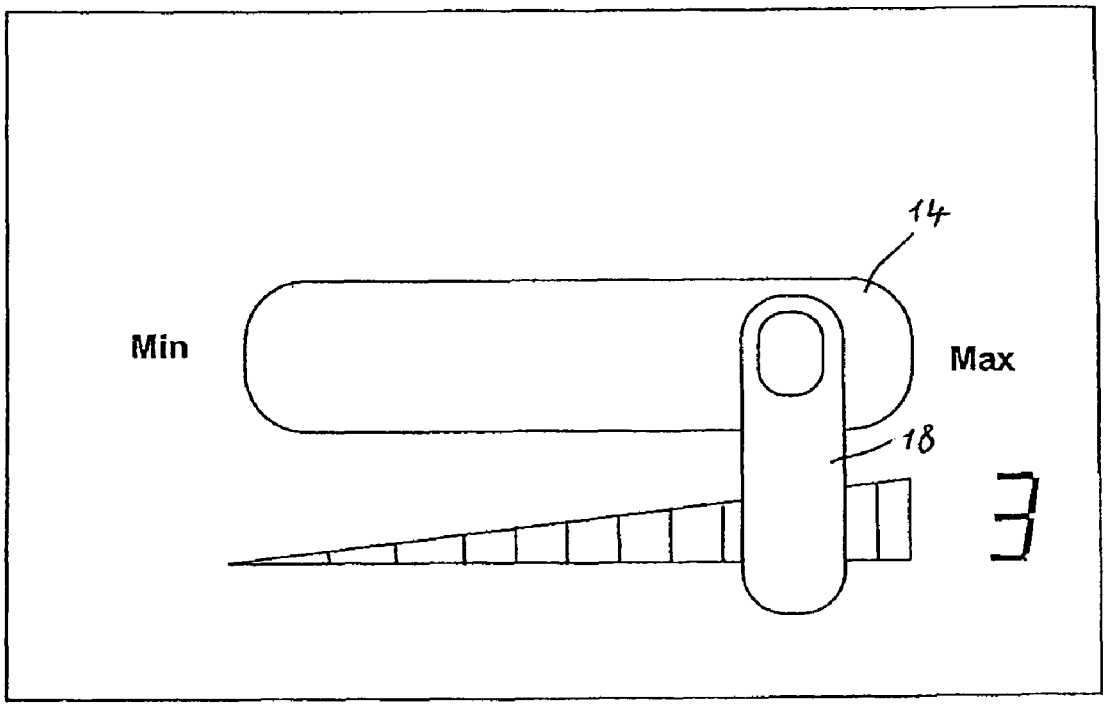
FIGS. 13*b* and 13*c* depict reducing the cook level by passing over the actuating surface from right to left.
Figure 13C:
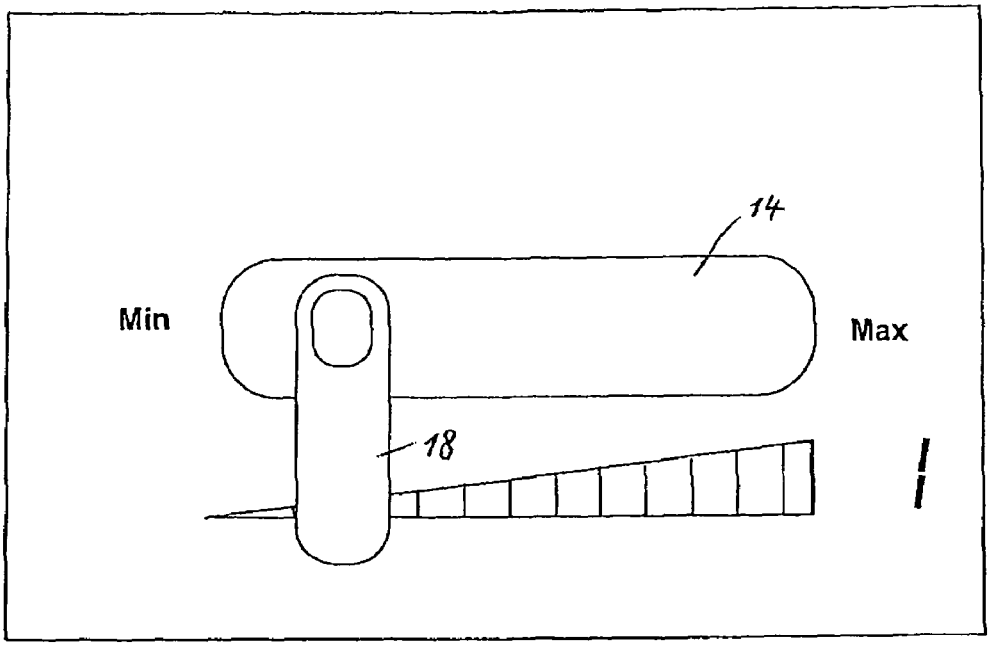
Figure 13C:
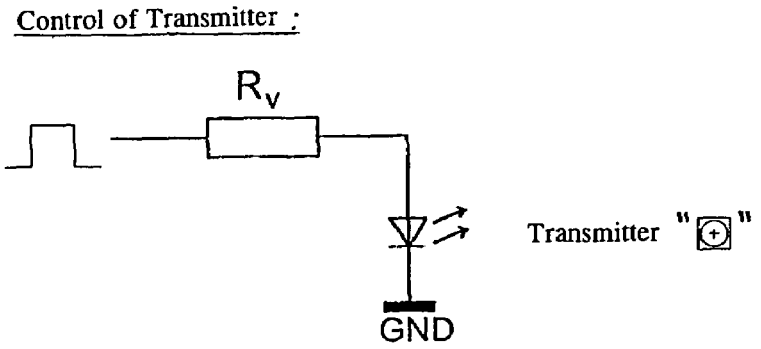

However, it is also possible to continuously change the cook level by passing over the actuating surface 14. In this case, passing over e.g. from the left to the right causes an increase in the cook level set most recently and passing over from the right to the left causes a decrease in the cook level set most recently. The finger 18 does not have to begin on the actuating surface 14 at the cook level just set. A finger movement to the left for reducing the cook level from "3" to "1" is depicted as an example in FIG. 13*b* in conjunction with FIG. 13*c*.

It is also possible in this manner to select the cook level "0" without passing over the actuating surface 14 down to the left-hand limit MIN. The OFF position must be marked very precisely for occupational safety reasons. This labeling can be done in the actuating surface 14 e.g. in that the left-hand edge of the actuating field 14 is emphasized with an OFF symbol.

Using an additional evaluation of the speed with which the actuating surface 14 is passed over, it is possible to cause the change in the cook level more rapidly, e.g. a rapid activation from the right to the left can be construed as a panic reaction because the item being cooked is boiling over or burning, and the cook level is reduced with corresponding speed. On the other hand, slowly passing over the actuating surface 14 can be construed as precisely selecting a cook level and the cook levels are changed at a correspondingly slower rate.

The time lapse for a setting process is typically as follows: the cooktop can be activated by placing the finger 18 onto the actuating field 14 of the cooktop sensor for a period of time specified in advance (e.g. 0.5 seconds). If the finger 18 is now moved over the sensitive area 14, the value X changes depending on actuation. If the desired X is now set, this value must be confirmed by pausing in that position for a certain period of time (e.g. 0.3 seconds). Alternatively, of course, it is also possible for the value X displayed after activation of the cook level to be assumed because the finger 18 pauses (direct selection).

This setting mode has the advantage that the complete cook level is considered like a sensor. Nearly the same properties are obtained for the operating line as with an individual sensor, which relates e.g. to the actuating interval and safety with regard to extraneous light turning the cooktop on. Moreover, withdrawing the finger on an inclined path no longer affects the value set due to the brief pause at the selected position (confirmation of the value set).

FIG. 14 depicts four straight exemplary embodiments of the inventive operating line. In each case, the IR transmitter diodes are arranged with lower density in the immediate vicinity of every second IR receiving element adjacent to the operating line. It is preferred that the number N2 of IR transmitter diodes be arrayed on only one side of the IR receiving elements that constitute the operating line 16. In accordance with FIG. 14, the IR receiving elements can also form a zigzag-shaped polygonal track on the operating line, which is straight overall. On its edges, each operating line can terminate either with a receiving element 4 and/or with a sensor pair 2 (comprising a receiving element 4 and a transmitter diode 6).

Deviating from the operating lines in accordance with FIG. 14, which are straight overall, the operating line in accordance with FIG. 15 can also be curved, the IR receiving elements 4 being able to form a zigzag-shaped polygonal course on the curved operating line.

Figure 16:
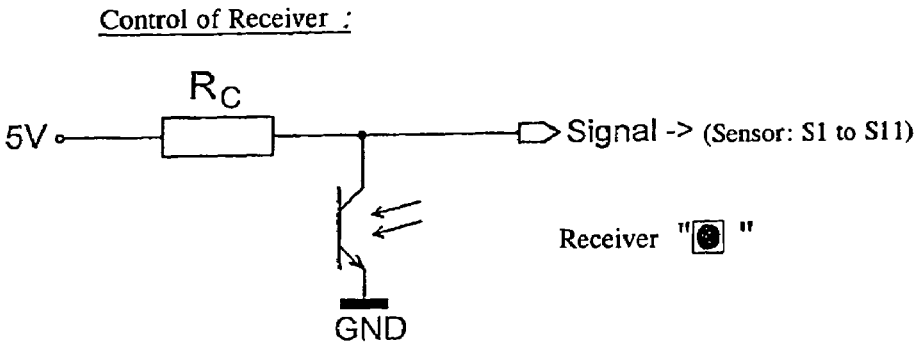
FIG. 16 depicts electrical block diagrams of the inventive transmitters and receivers.

FIG. 16 depicts electrical circuit diagrams of the inventive transmitters 6 and receivers 4. The transmitter diodes 6 are activated with light impulses as they are depicted at the top of FIG. 11. These control impulses are not visible to the operator, whether because the cooktop control was embodied as an infrared control and provided with IR transmitter diodes or because the control impulses in accordance with the top of FIG. 11 are too short to be perceivable to the human eye.

The receivers 4 are preferably embodied as IR phototransistors. In accordance with the circuitry in FIG. 16, elevated light intensity leads to a drop in the voltage of the emitter signal until saturation. Then the measurement signal can be standardized such that it is proportional to the intensity of the light signal to which the photoreceiver (including daylight filter) is sensitive. Examples of such standardized light measurement signals are depicted in the distributions in accordance with FIGS. 2 and 3.

The invention claimed is:

1. Control for a cooktop, comprising:

a plurality of first sensors and a plurality of second sensor pairs arranged along an operating line with a first sensor of the plurality of first sensors alternating with a second sensor pair of the plurality of second sensor pairs, along the entire operating line;

wherein each first sensor of the plurality of first sensors comprises an infrared receiving element without an infrared transmitter element, and each second sensor pair of the plurality of second sensor pairs comprises an infrared transmitter diode element and an infrared receiving element, and wherein the plurality of first sensors and plurality of second sensor pairs together comprise at least twice as many of said infrared receiving elements in total as said infrared transmitter diode elements;

wherein the operating line formed by the plurality of first sensors and the plurality of second sensor pairs is arranged to have common spacing density between each one first sensor and each adjacent second sensor pair, such that an operator's finger placed on said operating line necessarily covers at least one element among said plurality of said first sensors and said plurality of second sensor pairs, and such that infrared light radiated from an infrared transmitter diode element of a given one second sensor pair reflects onto said given one second sensor pair's infrared receiving element and an infrared receiving element of a first sensor to each side of the given one second sensor pair along the operating line.

2. Control for a cooktop in accordance with claim 1, wherein the operating line is straight.

3. Control for a cooktop in accordance with claim 1, wherein said operating line is curved.

4. Control for a cooktop in accordance with claim 2, wherein each one infrared receiving element among the plurality of first sensor and each one infrared receiving element among the plurality of second sensor pairs are arranged along a straight line and have a common spacing.

5. Control for a cooktop in accordance with claim 1, further comprising a base on a top side of which said infrared transmitter diode elements of said plurality of second sensor pairs and said infrared receiving elements of said plurality of first sensors and plurality of second sensor pairs are arranged with a low structural height.

6. Control for a cooktop in accordance with claim 1, further comprising a base in which are formed recesses and on a bottom side of said base are arranged said infrared transmitter diode elements and said infrared receiving elements so that the infrared light from said infrared transmitter diode elements is reflected through said recesses.

7. Control for a cooktop in accordance with claim 6, wherein said recess comprises a single elongated hole for all of said infrared transmitter diode elements among said second plurality of sensor pairs and all of said infrared receiving elements among said plurality of first sensors and plurality of second sensor pairs.

8. Control for a cooktop in accordance with claim 6, wherein said recesses comprise apertures or elongated holes for each of said infrared receiving elements.

9. Control for a cooktop in accordance with claim 1, further comprising a daylight filter, the infrared receiving elements being fitted with the daylight filter.

10. Control for a cooktop in accordance with any one of claims 5 through 9, further comprising display elements that radiate a wavelength in the visible range.

11. Control for a cooktop in accordance with claim 1, further comprising a source of impulse signals and wherein said infrared transmitter diode elements are activated by said impulse signals and transmit corresponding light impulses.

12. Method for manually adjusting settings on a control for a cooktop in accordance with claim 1, comprising positioning an operator's finger so that both a radiation from an effected diode transmitter element is reflected from said finger and also concurrently a radiation of ambient light is thrown into shadow by said finger, wherein the plurality of first sensors and plurality of second sensor pairs are arranged at an interval so that a least one infrared receiving element is effected by the shadow;

detecting combined infrared and ambient incident light for all receiving elements; and evaluating position of said finger based on at least a receiving element that detects a shadow of ambient light and on said reflection of infrared radiation onto at least three receiving elements adjacent to said effected diode transmitter, including said receiving element detecting said shadow.

13. Adjusting method accordance with claim 12, wherein said infrared radiation reflected by said finger which is a basis for evaluating said finger position comprises radiation from said effected infrared diode transmitter element and the ambient light thrown into shadow by said finger which is also a basis for evaluating said finger position comprises an infrared portion.

14. Adjusting method in accordance with claim 12 or 13, wherein said evaluating of said finger position further comprises detecting incident light quantitatively on all of said receiver elements among said plurality of first sensor and plurality of second sensor pairs and from this calculating a current position of said finger on said operating line, the position calculation comprising finding a median point or an extreme value of an intensity distribution of said incident light onto all of said receiver elements.

15. Adjusting method in accordance with claim 12, further comprising said finger touching a predetermined location on said operating line thereby directly selecting, a cook level associated with said location.

16. Adjusting method in accordance with claim 15, further comprising passing said finger along said operating line in any area thereby to effect an incremental increase or lowering of a cook level set most recently.

17. Adjusting method in accordance claim 16, further comprising pausing said finger at a position on said operating line for a predetermined minimum time period thereby to confirm and adopt a displayed and desired setting value for the cook level.

18. Adjusting method in accordance with claim 15, wherein said control comprises an actuating surface effecting communication with said sensors and said method further comprises, before said setting of said cook level, placing said finger onto said actuating surface for a predetermined minimum period of time thereby to activate said cooktop.

* * * * *